US005309817A

United States Patent [19]

Sims

[11] Patent Number: 5,309,817

[45] Date of Patent: May 10, 1994

[54] LINEAR BRAKE FOR FLUID ACTUATOR

[76] Inventor: James O. Sims, 1100 Brooks St., Decatur, Ala. 35601

[21] Appl. No.: 28,934

[22] Filed: Mar. 5, 1993

[51] Int. Cl.[5] ..... F01B 11/02

[52] U.S. Cl. ..... 92/85 A; 92/85 B

[58] Field of Search ..... 92/85 R, 85 A, 85 B, 92/130 R, 24, 26, 143, 29, 15, 23

[56] References Cited

U.S. PATENT DOCUMENTS

| | | | |
|---|---|---|---|
| 2,204,279 | 6/1940 | Meyer | 92/85 A |
| 2,396,052 | 3/1946 | Light | 92/85 A |
| 2,408,338 | 9/1946 | Parsons | 92/85 A |
| 3,605,409 | 9/1971 | Heese et al. | 92/85 B |
| 4,250,793 | 2/1981 | Berg | 92/85 B X |
| 4,611,634 | 9/1986 | Kruckenwitt et al. | 92/85 B X |

FOREIGN PATENT DOCUMENTS

| | | | |
|---|---|---|---|
| 1395857 | 5/1988 | U.S.S.R. | 92/85 B |
| 1439504 | 6/1976 | United Kingdom | 92/85 A |

*Primary Examiner*—Edward K. Look
*Assistant Examiner*—Hoang Nguyen
*Attorney, Agent, or Firm*—Phillips & Beumer

[57] ABSTRACT

A linear braking mechanism for fluid actuators defined by a cylinder enclosing a cavity having a piston/piston rod assembly reciprocally mounted therein. The braking mechanism includes a spring biased body which is disposed for engaging and retarding the movement of the piston as it nears the end of its travel. A pressure equalizing metering port is provided in the body of the braking mechanism to equalize pressure on opposite sides of the spring biased body.

10 Claims, 3 Drawing Sheets

LINEAR BRAKE FOR FLUID ACTUATOR

FIELD OF THE INVENTION

The present invention relates generally to fluid actuators and more particularly to such fluid actuators having brake means for gradually slowing the movement of the piston and piston rod as the piston nears the end of its stroke.

BACKGROUND OF THE INVENTION

Typically fluid actuators include a piston rod/piston assembly which is mounted in a cylinder (housing) for reciprocal movement therein. The cylinder may be provided with a single end cap to completely close off one end of the cylinder, or the cylinder may be completely enclosed by an end cap at one end and a cylinder head at its other end, if desired. The fluid pressure normally exerts high pressures on the piston, and when the piston reaches the end of its travel, stops suddenly, and reverses the direction of movement, undesirable vibrations tend to occur. Furthermore, such vibrations and sudden stops tend to have adverse effects on the seals on the piston, per se, and on the seals which seal the end cap and cylinder head to the cylinder body. However, when the pistons are subjected to a "buffering" effect at the end of its travel, these adverse effects are eliminated.

One typical solution to the problem has been to provide a tapered, projecting surface on the piston which mates with a tapered recess on the end sealing members of the cylinder so that as the piston nears the end of its travel, the tapered surface on the piston face enters the tapered recess of the end sealing members, and the fluid in the tapered recess tends to retard the entry of the projecting piston surface therein, thus somewhat retarding the piston movement.

It is, therefore, an object of the present invention is to provide a linear braking system for fluid actuators which serves as a means to gradually retard the rate of movement of a reciprocally movable piston/piston rod assembly in a cylinder housing as the piston/piston rod assembly changes its direction of movement.

It is another object of the present invention to provide such a linear brake system which serves as a buffer between end members of the cylinder housing and the piston of the piston/piston rod assembly.

It is a further object of the present invention to provide such a braking system with resilient shock-absorbing means to absorb the shock of the suddenly stopping piston as the piston reverses directions in its reciprocal movement.

It is still a further object of the present invention to provide such a braking system with fluid pressure equalization means to equalize the fluid pressure on one side of the brake body with pressure on the second side of the brake body responsive to the piston reaching the end of its travel.

DESCRIPTION OF THE PREFERRED EMBODIMENT

Figure 1:
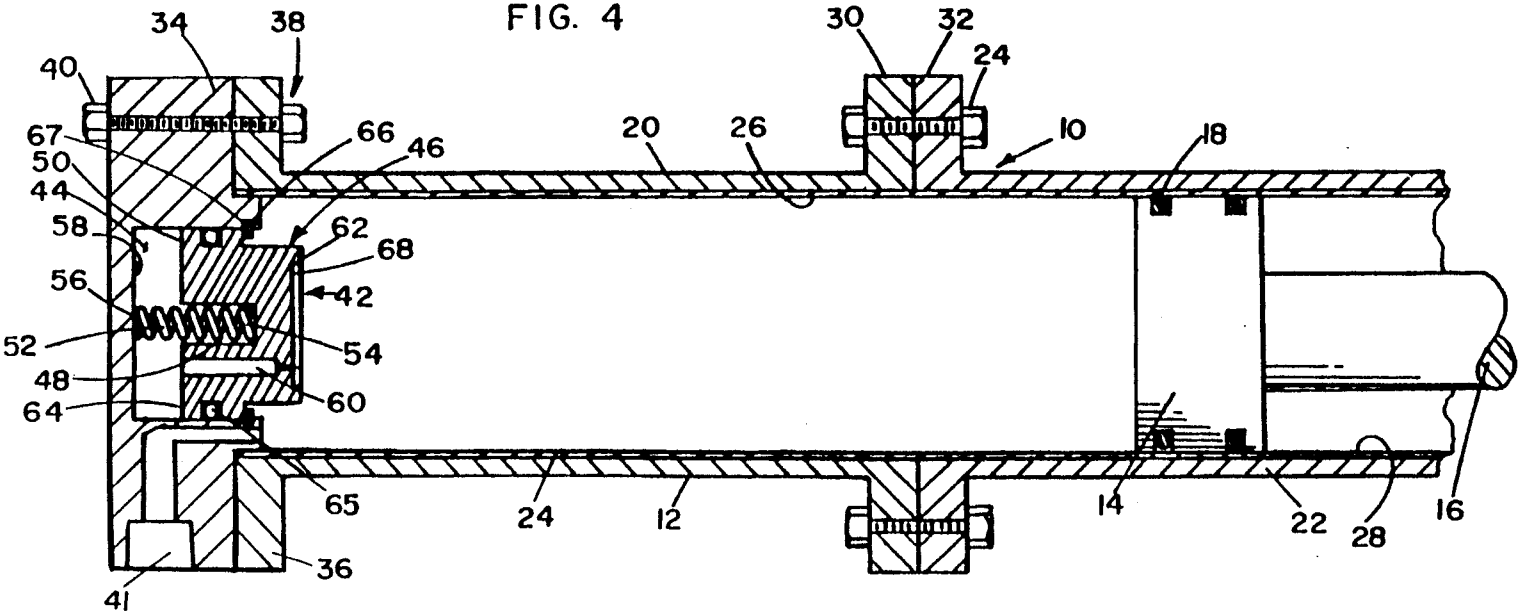
FIG. 1 is an elevational sectional view of a fluid actuator assembly including a cylinder housing having an end cap with the linear brake system of the present invention being incorporated in the end cap.

As seen in FIG. 1, a fluid actuator assembly 10 is shown to include a cylindrical housing 12 having a piston 14 reciprocally mounted therein. A piston rod 16 is secured to the piston and extends out of the cylinder for attachment to a workpiece (not shown) for reciprocal movement thereof. O-ring seals 18 or the like are provided around piston 14 to prevent fluid leakage around the piston. In the embodiment shown in FIG. 1, the cylinder housing 12 is shown to be configured in sections 20 and 22 and having a single replaceable liner 24 lining the internal walls 26 and 28 of sections 20 and 22 of the cylinder housing 12. Flanges 30 and 32 are provided on sections 20 and 22 for bolted relation by bolts 24 to secure the sections 20 and 22 together. An end cap 34 is shown to be secured to a flange 36 provided on an end 38 of cylinder housing 12 by bolts 40. A fluid inlet/outlet 41 is provided in end cap 34.

To prevent sudden abrupt stops from occurring as the piston reaches the end of its travel, buffering means in the form of a linear brake assembly 42 is provided on the inside of cylinder housing 12. Brake assembly 42 (FIG. 1) is mounted in a recess 44 (typically annular) provided in end cap 34 and disposed for receiving a brake body 46 reciprocally therein. Body 46 o includes a recess 48 in a surface 50 thereof. A spring 52 has one end 54 thereof mounted and seated in recess 48 of body 46, and the other end 56 of spring 52 seats against an inner surface 58 of end member 34 in recess 44. A fluid metering passage 60 extends axially through body 46 to permit fluid to be directed from the forward side 62 of body 60 to the rear side 64 of body 46 to substantially equalize pressure on both sides of the body 46 as it is moved toward the inner surface 50 of end member 34 as a result of being displaced by piston 14. The rate of movement of body 46 is controlled by the size (diameter) of the metering port. A seal 65 (O-ring or the like) is provided on body 60, and a removable clip or retainer 66 is provided in a groove 67 disposed in the interior surface of recess 44 of body 46. Body 46 is provided with a recessed area 68 in forward side 62 thereof to prevent suction between the rear face of the piston and side (surface) 62 of brake body 46.

Figure 4:
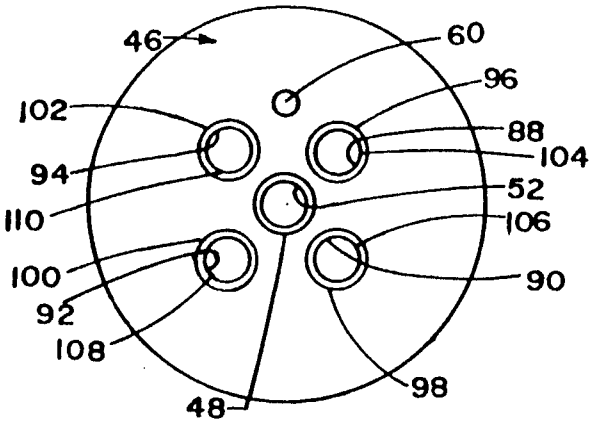
FIG. 4 is a sectional view taken along line 4—4 of FIG. 2.
Figure 2:
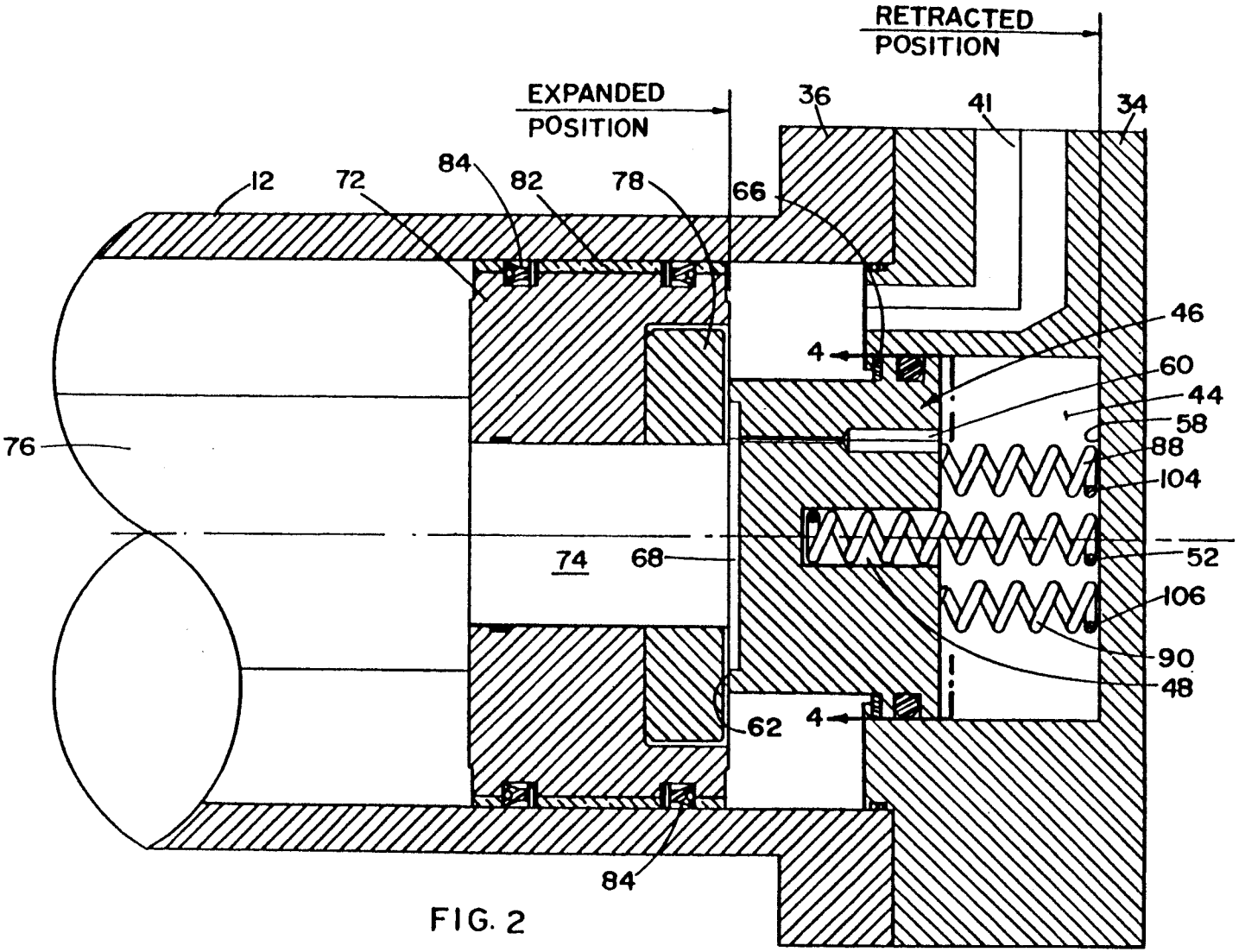
FIG. 2 is an elevational sectional view of another embodiment of the linear brake system of the present invention wherein the linear brake system is incorporated in the end cap of a fluid actuator assembly.

FIGS. 2 and 4 illustrate another embodiment of the present invention wherein like reference numerals refer to like parts. As seen in FIG. 2, fluid actuator assembly 10 is shown to include cylinder 12 which encloses a piston 72 which is secured threadably to a reduced externally threaded section 74 of a piston rod 76 by a spanner nut 78. Piston 72 is shown to have a replaceable liner 82 thereon. Seals and/or wiper members indicated by the numeral 84 are mounted on the outer periphery of the piston. The fluid actuator assembly includes end cap 34 secured to a flange 36 of cylinder housing 12 and having a fluid inlet/outlet 41 as discussed, supra. However, in this embodiment, while the structure of the body 46 is substantially as described above, the assembly uses a plurality of springs 88, 90, 92, and 94 disposed around centrally (axially) located spring 52, which is mounted on the center line 80 of the assembly. Each spring 88, 90, 92, and 94 is respectively positioned in openings or recesses 96, 98, 100, or 102. The openings extend into the body (in a manner similar to recess 48, discussed supra) to form a seat for the inner ends of each spring 88, 90, 92, and 94, and each of the springs 88, 90, 92, and 94 is respectively provided with outer ends 104, 106, 108, D and 110 which seat against the inner surface 58 of recess 44 of end cap 34 as does the central spring 52, as discussed supra. Pressure equalizing metering passage 60 extends through body 46, as discussed supra. Clip 66 retains the body 46 in place, and recessed area 68 prevents undesirable suction between the plug and piston as discussed supra.

Figure 3:
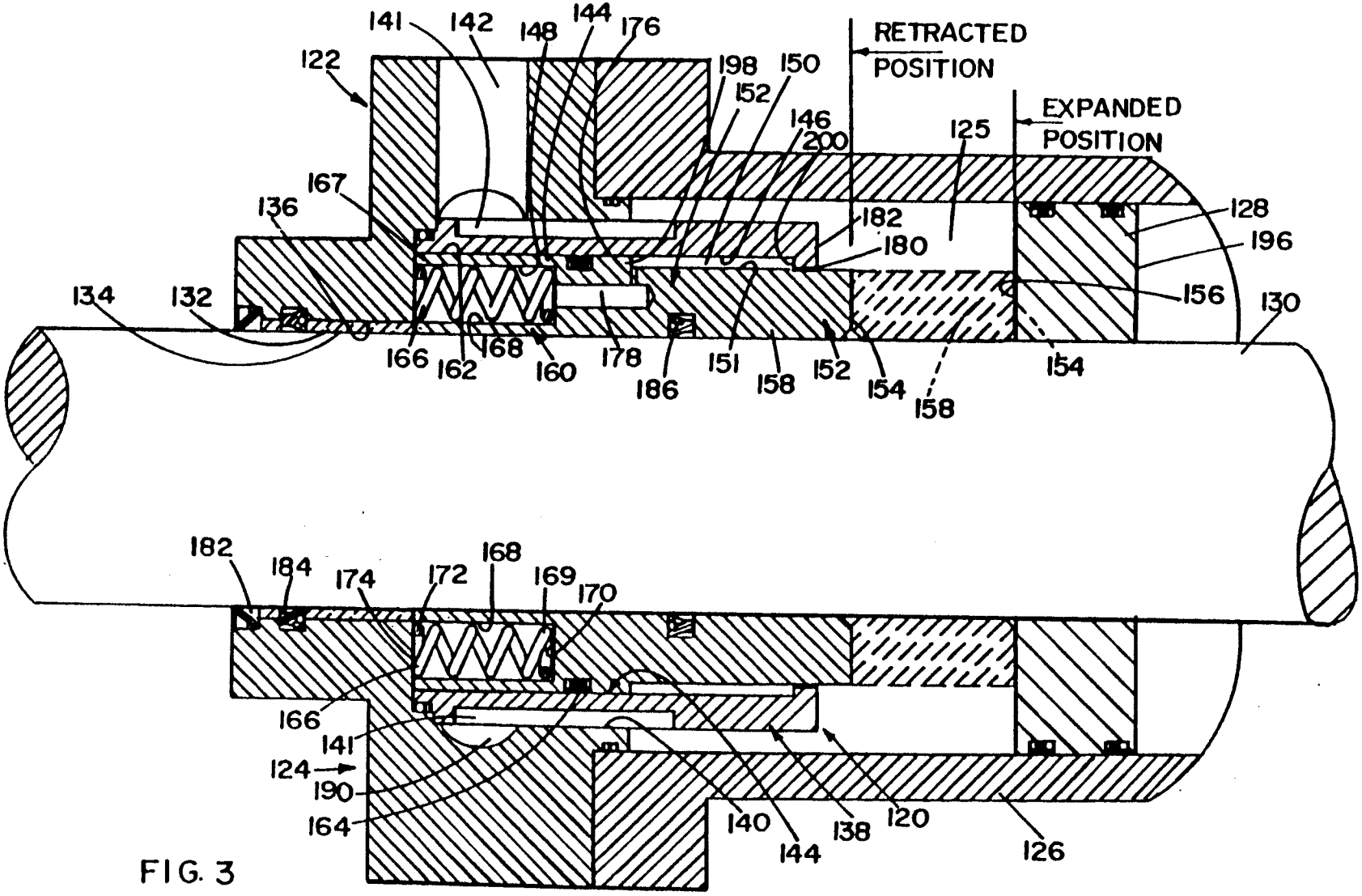
FIG. 3 is an elevational sectional view of an embodiment of the present invention which is incorporated in the cylinder head of the fluid actuator assembly.

FIG. 3 illustrates another embodiment of the present invention wherein like reference numerals refer to like parts. As seen in FIG. 3, a linear brake assembly 120 is mounted in the cylinder head 122 of a fluid actuator assembly 124. The fluid actuator assembly 124 is shown to include a cylinder housing 126 having a piston 128 and piston rod 130 reciprocally mounted therein. Rod 130 extends through the linear brake assembly 120 and out of the cylinder through an opening 132 in a sleeve 134 mounted in bore 136 of cylinder head 122.

The linear brake assembly 120 is shown to include a cylindrical housing 138 which is non-movably secured inside a bore 140 of cylinder head 122. Housing 138 is provided an annular groove 141 on its outer surface. Groove 141 serves as a fluid passage between a fluid inlet/outlet 142 and the interior 125 of the cylinder housing 126 as described hereinbelow. Housing 138 is provided with an internal bore 144 having forward and rear portions 146 and 148. Forward portion 146 forms an annular space 150 between an outer surface 151 of brake body 152 of the linear brake assembly. Body 152 is slidably mounted in housing 138 and is disposed for slidable movement responsive to engagement between a forward face 154 of body 152 and a face 156 of piston 128. This point of engagement between the piston and body 152 is illustrated in FIG. 3 wherein dot-dash lines illustrate the position of body 152 when the body is in its extended (non-compressed) position, which is the position of the body prior to being slid rearwardly in housing 138 responsive to movement of the body 152 by piston 128.

The body 152 includes a forward portion 158 having face 154 thereon and a rear portion 160 having an outer surface 162 slidably mounted in rear bore portion 148 of housing 138. A seal member 164 is disposed in an annular groove disposed in the periphery of the annular body 152. A plurality of springs 166 are provided in a plurality of recesses 168 disposed in the rear portion 160 of annular body 152. The number of recesses and springs are dependent on the fluid pressure of the fluid actuator system, typically four to six springs and recesses are provided. Each spring 166 includes an end 169 which abuts and is retained, if desired, (in a known manner) against a bottom surface 170 of each recess 168. The other end 172 of each spring 166 extends out of the recesses past rear surface 167 of body 138 for abutting relation with an inner surface 174 of cylinder head 122 responsive to rearward movement of body 152.

A metering port 176 is provided in body 152 between a passage 178 (or passages) which is disposed in body 152 in communication with selected ones or all of the recesses 166. Metering port 176 communicates between passage 178 and annular space 150 provided between body 152 and cylindrical housing 128. Space 150 communicates with into the interior 125 of cylinder 126 through an annular passage (or a plurality of peripherally spaced annular passages) 180 provided between an inwardly projecting shoulder 182 of the forward portion of housing 138 and the forward portion 158 of body 152. Scrapers 182 and seals 184 are shown to be mounted in the head 122 in engagement with the outer surface of piston rod 130. Similarly, a seal 186 is shown to be carried on body 138 in contact with the outer surface of piston 130.

In operation, to move the piston to the right as viewed in FIG. 3, fluid is admitted into a manifold 190 through inlet 142 and directed through annular groove 141 of cylindrical body 138 and into the interior 125 of cylinder 126 to exert a force on face 156 of piston 128. To actuate the linear brake assembly, fluid is directed into the cylinder at its other end (not shown) to exert a force against a face 196 of piston 128 for movement of piston 128 to the left (as viewed in FIG. 3). After a predetermined amount of travel, the piston face 156 engages the face 154 of the extended (springs not compressed) linear brake body 152 to move the linear brake body 152 to the left until the springs 166 are compressed against surface 174 of head 122 (as shown in FIG. 3). To enhance the "buffering" effect of the brake system by substantially equalizing the fluid pressure on both sides of the linear brake body 152, port 176 meters fluid flow on both sides of body 152. It can be seen that as the piston 128 moves to the left, the fluid in the interior 125 of the cylinder is forced rearwardly through passage 180, into space 150, through metering port 176, into passage 178, and through recesses 168 and between the rear surface 167 of body 152 and forward surface 174 of cylinder head 122.

As can be seen in FIG. 3, body 152 is provided with an annular shoulder 198 which serves as a stop which engages the inner surface 200 of projecting shoulder 182, to limit movement of the body 152 in housing 138.

It is to be understood that while passage 180 is described as being a single annular passage means between body 152 and shoulder 182 of housing 138, the passage means may, if desired, be a plurality of longitudinal passages spaced around the outer periphery of the forward portion of body 152. Similarly, the single annular passage 141 may be a plurality of annularly disposed recesses, if desired.

I claim:

1. A fluid actuator having a cylinder enclosing a cavity having a piston/piston rod assembly disposed therein for reciprocal travel, said fluid actuator comprising:

an end sealing member disposed in secured relation with one end of said cylinder, said end sealing member having a first cavity therein, said cavity defined by a base surface and an annular wall extending from said base surface;

brake means carried in said cavity of said end sealing member and including a single circular body member having an outer surface and first and second end surfaces, said outer surface having a shoulder thereon, said member disposed for reciprocal movement between a first extended position whereby said first end surface of said body is disposed in spaced-apart relation with said base surface of said recess and a second retracted position wherein said first end surface of said body is proximate said base surface, said brake means including retarding means for maintaining said body in said first extended position prior to engagement by said piston and for providing a retarding action to said piston responsive to engagement thereby as said body is moved to said second retracted position;

fluid metering means disposed in said body for metering fluid flow through said body to substantially equalize fluid pressure on said first and second surfaces of said body responsive to engagement and movement of said body means by said piston, said fluid metering means defined by a continuous bore extending through said member and communicating with said cylinder cavity and said recess of said end sealing member;

retaining means for retaining said body in said recess of said end cap, said retaining means defined by a projection inwardly extending from said annular wall surface of said cavity of said end sealing member for engagement with said annular shoulder of said body responsive to the reciprocal movement thereof to limit the movement of said body in said cavity and to retain said member in said cavity; and suction prevention means provided on said second surface of said body to prevent undesirable suction from occurring between said piston and aid second surface of said body.

2. Apparatus as in claim 1 wherein said cavity wall is provided with an annular groove therein, and aid projection is defined by a snap ring removably positioned in said annular recess of said cavity wall.

3. Apparatus as set forth in claim 2 wherein said body is provided with a plurality of second recesses disposed in said first surface of said body, each said plurality of second recesses having a spring mounted therein and extending therefrom for engaged relation with said base surface of said cavity of said end sealing member.

4. Apparatus as in claim 3 wherein said suction prevention means is a recess formed in said second surface of said body.

5. A fluid actuator having a cylinder enclosing a cavity having a piston/piston rod assembly disposed therein for reciprocal travel, said fluid actuator comprising:

an end sealing member disposed in secured relation with one end of said cylinder;

brake means carried in said cylinder and including a body having first and second end surfaces, said body disposed for reciprocal movement between a first extended position whereby said first surface of said body is disposed in spaced-apart relation with said end sealing member and a second retracted position wherein said first surface of said body is proximate said end sealing member, said brake means including retarding means for maintaining said body in said first extended position prior to engagement by said piston and for providing a retarding action to said piston responsive to engagement thereby as said body is moved to said second retracted position, said brake means including a cylindrical brake housing secured in said end sealing member, said body being reciprocally mounted in said cylinder housing, and stop means carried in said cylindrical housing for engaged relation with said body to limit the movement of said body in said cylindrical housing; and fluid metering means disposed in said body for metering fluid flow through said body to substantially equalize fluid pressure on said first and second surfaces of said body responsive to engagement and movement of said body means by said piston, said fluid metering means being provided by passage means including first fluid passage means formed between said cylindrical housing and said body and in communication with the interior of said cylinder, and second passage means provided in and extending through said body, said second passage communicating with said first passage means and said second end surface of said body.

6. Apparatus as in claim 1 wherein said retarding means is defined by spring means disposed between said first end surface of said body and said base surface of said cavity.

7. Apparatus as in claim 5 wherein said cylindrical housing includes an extending end portion extending into said cylinder, and said stop means being carried on said extending end portion.

8. Apparatus as in claim 7 including an annular shoulder disposed on said body for engagement with said stop means carried on said cylindrical housing.

9. Apparatus as in claim 8 wherein said body is provided with recess means in said second surface, said recess means disposed for seating said retaining means therein.

10. Apparatus as in claim 9 wherein said recess means is disposed in communication with said first and second passages to provide fluid flow between said first and second end surfaces of said body.

* * * * *